US007219639B2

(12) United States Patent
Engelhardt et al.

(10) Patent No.: US 7,219,639 B2
(45) Date of Patent: May 22, 2007

(54) DRAG LEVER OF A VALVE MECHANISM IN AN INTERNAL COMBUSTION ENGINE

(75) Inventors: Helmut Engelhardt, Herzogenaurach (DE); Johann Kecker, Herzogenaurach (DE); Jörg Michel, Schwarzenbach am Wald (DE)

(73) Assignee: INA-Schaeffler KG (DE)

( * ) Notice: Subject to any disclaimer, the term of this patent is extended or adjusted under 35 U.S.C. 154(b) by 43 days.

(21) Appl. No.: 10/532,780

(22) PCT Filed: Oct. 14, 2003

(86) PCT No.: PCT/EP03/11344

§ 371 (c)(1),
(2), (4) Date: Sep. 30, 2005

(87) PCT Pub. No.: WO2004/038186

PCT Pub. Date: May 6, 2004

(65) Prior Publication Data

US 2006/0225680 A1 Oct. 12, 2006

(30) Foreign Application Priority Data

Oct. 24, 2002 (DE) ..... 102 49 561

(51) Int. Cl.
*F01L 1/14* (2006.01)

(52) U.S. Cl. ..... 123/90.48; 123/90.52; 123/90.55; 123/90.41; 123/90.45; 74/569

(58) Field of Classification Search ..... 123/90.48
See application file for complete search history.

(56) References Cited

U.S. PATENT DOCUMENTS

| | | | | |
|---|---|---|---|---|
| 3,002,507 A | | 10/1961 | Bensinger et al. | |
| 3,880,128 A | | 4/1975 | Stirrat | |
| 4,539,953 A | * | 9/1985 | Sasaki et al. | 123/90.41 |
| 4,762,099 A | | 8/1988 | Fujii et al. | |
| 5,775,280 A | | 7/1998 | Schmidt et al. | |
| 6,047,675 A | * | 4/2000 | Kunz | 123/90.41 |
| 6,491,012 B2 | * | 12/2002 | Pryba et al. | 123/90.41 |

FOREIGN PATENT DOCUMENTS

| | | |
|---|---|---|
| DE | 7001470 | 1/1971 |
| DE | 38 00 524 | 7/1985 |
| DE | 297 07 987 | 8/1997 |
| DE | 197 14 822 | 10/1998 |
| DE | 197 17981 | 10/1998 |
| DE | 197 30 201 | 1/1999 |
| EP | 0 286 389 | 10/1988 |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

Disclosed is a drag lever (1) comprising two side walls (2, 3) which are connected together by a transversal bar (4) which is arranged on an end (6) of the lower side (5) thereof on an end (6) thereof on a head of a support element (9) by means of a dome-shaped cavity (7) on a head (8) of a support element (9). A clamp (10) is applied to the end (6) thereof. The clamp fixes the drag lever (1) to the head such that it can be displaced in a pivoting direction thereof. The clamp (10) is made of thin-walled wire material and extends essentially in a transversal manner in relation to the longitudinal axis of the drag lever (1) and is arranged on the lower side (5) of the transversal bar (4) by means of a central section (11) which is formed by webs (12, 13) which extended in a semi-circular manner in a part of the support element (9) which has a reduced diameter (14) and is located below said head (8). The clamp (10) continues on each outer surface (15, 16) of a corresponding side wall (2, 3) by means of two parallel projections (17*a*, 17*b*, 18*a*, 18*b*) and the ends of said projections are snapped on an upper side (19, 20) of the respective side wall (2, 3) or on a bearing surface which is essentially parallel to the upper side (2, 3) such that at least more than half of the upper side (19, 20) or the bearing surface is covered.

8 Claims, 1 Drawing Sheet

DRAG LEVER OF A VALVE MECHANISM IN AN INTERNAL COMBUSTION ENGINE

This application is the U.S. national stage of PCT/EP03/11344 filed Oct. 14, 2003.

FIELD OF THE INVENTION

The invention concerns a finger lever of a valve train of an internal combustion engine, said finger lever comprising two side walls that are connected to each other by a crossbeam that acts through an underside at one end on at least one gas exchange valve and is mounted at a further end through a concave cavity on a head of a support element, a clip through which the finger lever is fixed in position on said head for displacement in a direction of pivot being applied to said further end.

BACKGROUND OF THE INVENTION

A finger lever of the pre-cited type is disclosed in DE 35 00 524 C2 that is considered to be generic. A leg of the clip disclosed in this document extends in the direction of extension of the finger lever. During a pivoting motion of the finger lever generated by cam loading, this clip impedes the pivoting motion because bending work has to be performed. This has a detrimental effect on the friction in the valve train.

OBJECTS OF THE INVENTION

It is an object of the invention to provide a finger lever of the pre-cited type in which the aforesaid drawbacks are eliminated.

This and other objects and advantages of the invention will become obvious from the following detailed description.

SUMMARY OF THE INVENTION

The invention achieves the above objects by the fact that the clip is made of thin-walled wire material, extends substantially crosswise to a longitudinal axis of the finger lever and bears through a central section against the underside of the crossbeam, said central section being formed by two webs that extend on two side of a transverse plane that intersects the support element at a center point, said two webs having a semi-circular shape and extending in a diameter reduction of the support element under the head of the support element, the clip being continued through two parallel extensions on an outer surface of each of said two side walls, ends of said extensions being snapped onto one of an upper side of one of the side walls or onto a support surface substantially parallel to said upper side so as to engage more than at least one half of the upper side or of the support surface.

In this way, the aforesaid drawbacks are eliminated with simple measures. The finger lever can move freely in the direction of pivot and, at the same time, the wire-like clip constitutes a very economic and extremely light connecting means.

In place of the proposed wire material, the invention can also be realized with other materials having resilient properties such as, for instance, thin-walled plastics and fiber-reinforced plastics etc.

Although the invention provides that the ends of the extensions on both sides engage the upper sides of the side walls, it is also possible to implement the invention with only one set of ends configured in this way. The ends of the extensions are then snapped resiliently onto the upper side of the associated side wall. It is further provided by the invention to make one end longer so that it extends on an inner surface of one of the side walls so as to ensure a particularly reliable positional fixing.

To prevent a slipping of the clip of the invention in longitudinal direction of the finger lever, the ends of the clip can extend by choice at least on one upper surface in a depression. Alternatively, it is also proposed to arrange an elevation on at least one upper side, which elevation is surrounded on both sides by the ends of the clip.

In a further advantageous embodiment of the invention, the ends of the clip are united on the associated upper side by choice. This may be realized on one upper side, but also on both upper sides, so that either a clip open on one side or a completely closed clip is formed. In the latter case, it may be necessary to use suitable joining measures to obtain a clip with a closed configuration in the region of its ends.

Due to the fact that the extensions on the side walls are spaced from each other at a distance that is smaller than a diameter of the diameter reduction, an excellent enclosing of the diameter reduction by the semi-circular webs is guaranteed.

Finally, according to still another advantageous embodiment of the invention, the finger lever has a generally U-shaped cross-section. In place of the U-shaped cross-section it is also possible to configure the finger lever with a cross-section only similar in shape to a U or with an H-shaped cross-section. In combination with this feature, the invention proposes to make the finger lever out of sheet metal. Further materials will also occur to a person skilled in the art in this connection, for example, also plastics or a finger lever made by casting. The scope of the invention, however, also includes the U-shape not combined with sheet metal.

The invention will now be described more closely with reference to the appended drawing.

DETAILED DESCRIPTION OF THE DRAWING

Figure 1:
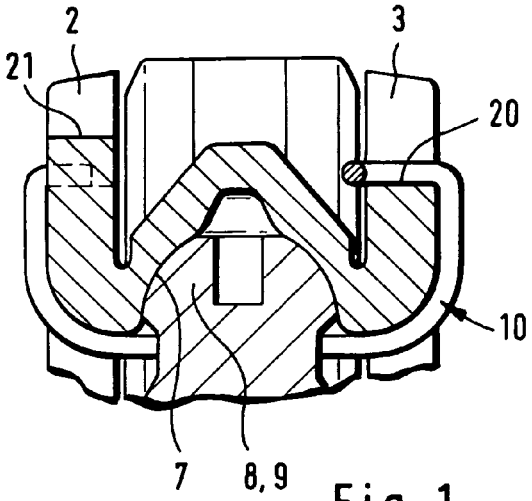
FIG. 1 shows a cross-section through a finger lever of the invention in a region of a support element.

The figures disclose a finger lever 1 that is made in the present case out of thin-walled sheet metal. This finger lever 1 is intended for use in a valve train of an internal combustion engine and comprises side walls 2, 3 that are connected to each other on their undersides by a crossbeam 4. Thus, as viewed in cross-section, the finger lever forms a U-profile. At its one end, not illustrated, the crossbeam 4 acts in lift direction on at least one gas exchange valve. At a further end, the finger lever 1 is mounted through a concave cavity 7 in the region of an underside 5 for pivoting on a head 8 of a support element 9. This support element 9 may be designed to operate hydraulically.

Through a clip 10 made preferably of thin-walled wire material and applied in the region of the further end 6, the finger lever 1 is connected to the support element 9 so as to be able to pivot freely in its direction of pivot. In this way, the finger lever 1 can be delivered together with the support element 9 as an assembled unit to the engine manufacturer and be completed in the cylinder head by the manufacturer. The clip 10, as an extremely cheap connecting element, at the same time prevents the finger lever 1 from slipping off the head 8 of the support element 9 before and during mounting in the valve train and also when the internal combustion engine is fired.

As a person skilled in the art will readily see in the figures, the clip 10 extends substantially crosswise to a longitudinal axis of the finger lever 1. The clip 10 comprises a central section 11 bearing against an underside 5 of the finger lever 1. This central section 11 comprises two webs 12, 13 each of which extends in the form of a semi-circle in a diameter reduction 14 under the head 8 of the support element 9. Laterally, the ends (not referenced) of the webs 12, 13 are pulled via the extensions 17*a*, 17*b* and 18*a*, 18*b* over a respective side wall 2, 3 of the finger lever 1 onto a respective upper side 19, 20. The ends are snapped, so to speak, onto the upper sides 19, 20.

Figure 2:
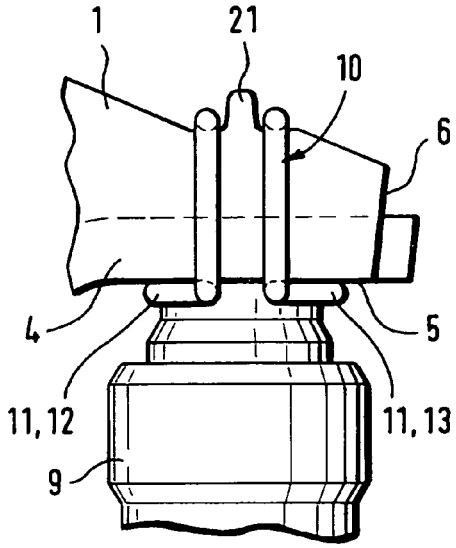
FIG. 2 is a side view of the finger lever of FIG. 1 comprising a clip of the invention.

As disclosed in FIGS. 1, 2, the upper sides 19, 20, or at least one upper side, can comprise an elevation 21 that is enclosed by the ends of the respective extensions 17*a*, 17*b* and 18*a*, 18*b*. In this way, a slipping of the clip 10 in the longitudinal direction of the finger lever 1 is prevented. In the embodiment of FIG. 1, only one upper side 19 comprises such an elevation 21. On the upper side 20, in contrast, the end of the clip 10 extends beyond the upper side 20 toward the central longitudinal plane of the finger lever 1 and has a closed configuration in this region. The ends on the upper side 19 are shown in an open state.

Figure 4:
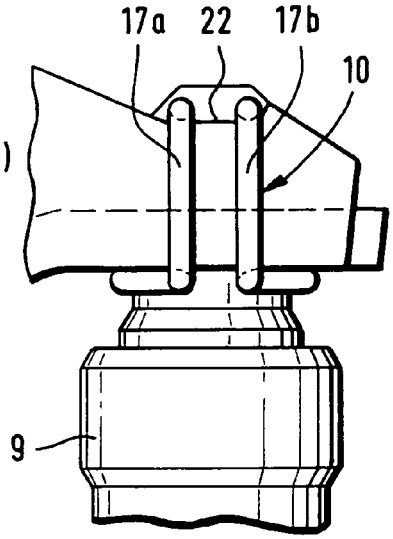
FIG. 4 is a side view of the finger lever of FIG. 3.

According to the illustration of FIG. 4, the ends (in the present case, those of the extensions 17*a*, 17*b* on the side wall 2) can also extend in a depression 22 on the upper side 19. This, too, is a method of preventing a slipping of the clip 10 in the longitudinal direction of the finger lever 1.

Figure 3:
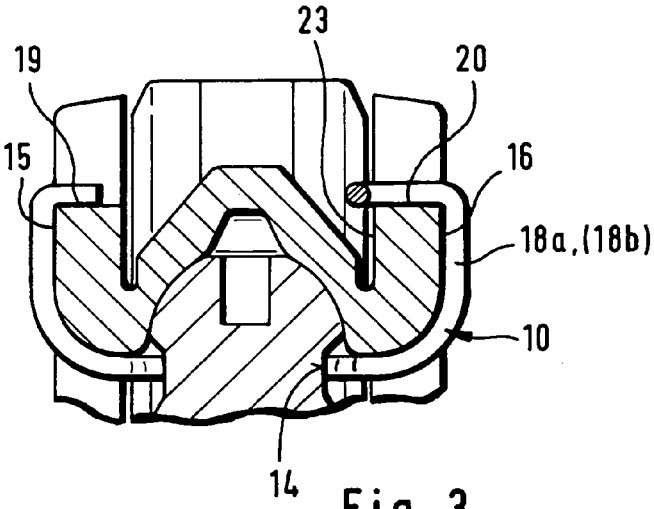
FIG. 3 shows the finger lever of FIG. 1 comprising a differently configured clip.

As disclosed in FIG. 3, it is, however, also possible, where appropriate, to omit the elevation 21 and the depression 22, so that the ends extend on upper sides 19, 20 having a smooth surface in this region.

FIG. 4 shows that the extensions 18*a*, 18*b* on the side wall 3 are united and that the opposing ends have an open configuration.

The invention claimed is:

1. A finger lever of a valve train of an internal combustion engine, said finger lever comprising two side walls that are connected to each other by a crossbeam that acts through an underside at one end on at least one gas exchange valve and is mounted at a further end through a concave cavity on a head of a support element, a clip through which the finger lever is fixed in position on said head for displacement in a direction of pivot being applied to said further end, wherein the clip is made of thin-walled wire material, extends substantially crosswise to a longitudinal axis of the finger lever and bears through a central section against the underside of the crossbeam, said central section being formed by two webs that extend on two sides of a transverse plane that intersects the support element at a center point, said two webs having a semi-circular shape and extending in a diameter reduction of the support element under the head of the support element, the clip being continued through two parallel extensions on an outer surface of each of said two side walls, ends of said extensions being snapped onto one of an upper side of one of the side walls or onto a support surface substantially parallel to said upper side so as to engage more than at least one half of the upper side or of the support surface.

2. A finger lever of claim 1, wherein at least one side wall comprises on the upper side, an elevation that is surrounded by at least one end of at least one of the extensions at least on one side.

3. A finger lever of claim 1, wherein at least one side wall comprises on the upper side, a depression in which the ends of the extensions on said at least one side wall are guided.

4. A finger lever of claim 1, wherein at least one side wall comprises on the upper side, two elevations between which the ends of the extensions on said at least one side wall are guided.

5. A finger lever of claim 1, wherein the extensions on the side walls are spaced from each other at a distance that is smaller than a diameter of the diameter reduction.

6. A finger lever of claim 1, wherein the ends of the extensions on at least one upper side are united and the ends of the extensions on the other upper side, in case of a united configuration only on one upper side, are open.

7. A finger lever on claim 1, wherein the ends of the extensions on at least one upper side extend completely over this upper side and are snapped through an end portion behind an inner surface of the side wall.

8. A finger lever of claim 1, wherein the finger lever has a generally U-shaped cross-section and is made of sheet metal.

* * * * *